United States Patent [19]

Roman

[11] Patent Number: 4,846,728

[45] Date of Patent: Jul. 11, 1989

[54] FLOATING SEAL ARRANGEMENT FOR CENTRIFUGAL SEPARATORS AND LIKE ROTATING APPARATUS

[75] Inventor: Donald C. Roman, Greenwood, Ind.

[73] Assignee: Equipment Engineering, Inc., Indianapolis, Ind.

[21] Appl. No.: 189,323

[22] Filed: May 2, 1988

[51] Int. Cl.[4] ..... B04B 9/00

[52] U.S. Cl. ..... 494/41; 277/27; 277/173

[58] Field of Search ..... 494/38, 41, 39; 277/27, 277/173, 177, 176, 59; 210/781, 782

[56] References Cited

U.S. PATENT DOCUMENTS

| | | | |
|---|---|---|---|
| 4,654,023 | 3/1987 | Foldhazy | 494/41 |
| 4,684,361 | 8/1987 | Feldman | 494/41 |
| 4,732,323 | 3/1988 | Jarvis | 277/27 |

*Primary Examiner*—Robert W. Jenkins
*Attorney, Agent, or Firm*—Kalish & Gilster

[57] ABSTRACT

Rotating fluid-handling apparatus, e.g., a centrifugal separator has at least first and second elements which rotate relative to the other about a common axis. A seal assembly provides fluid-tight sealing between the elements, which define passages for fluid flow from one element to the other. The seal assembly has at least one annular seat carried by one of the elements coaxially with the axis, and an annular seal, the other of the elements defining a chamber for the seal in proximity to the seat. The chamber carries the seal within it coaxial with the axis, the seal being shiftable axially within the chamber between positions, in and out of sealing contact with the seat. Sealing contact with the seat is provided over an annular sealing surface area. The seal and chamber are mutually configured for causing fluid flow from one element to the other through the passages for producing shifting of the seal from the out-of-contact position to the in-contact position to cause the sealing surface area to be maintained in fluid-tight, fluid-lubricated relationship with the seat in response to pressure produced by the fluid flowing from one element to the other during rotation, yet permitting shifting of the seal to the out-of-contact position in the absence of said pressure, so as to avoid fluid-unlubricated contact of the seal with the seat.

16 Claims, 2 Drawing Sheets

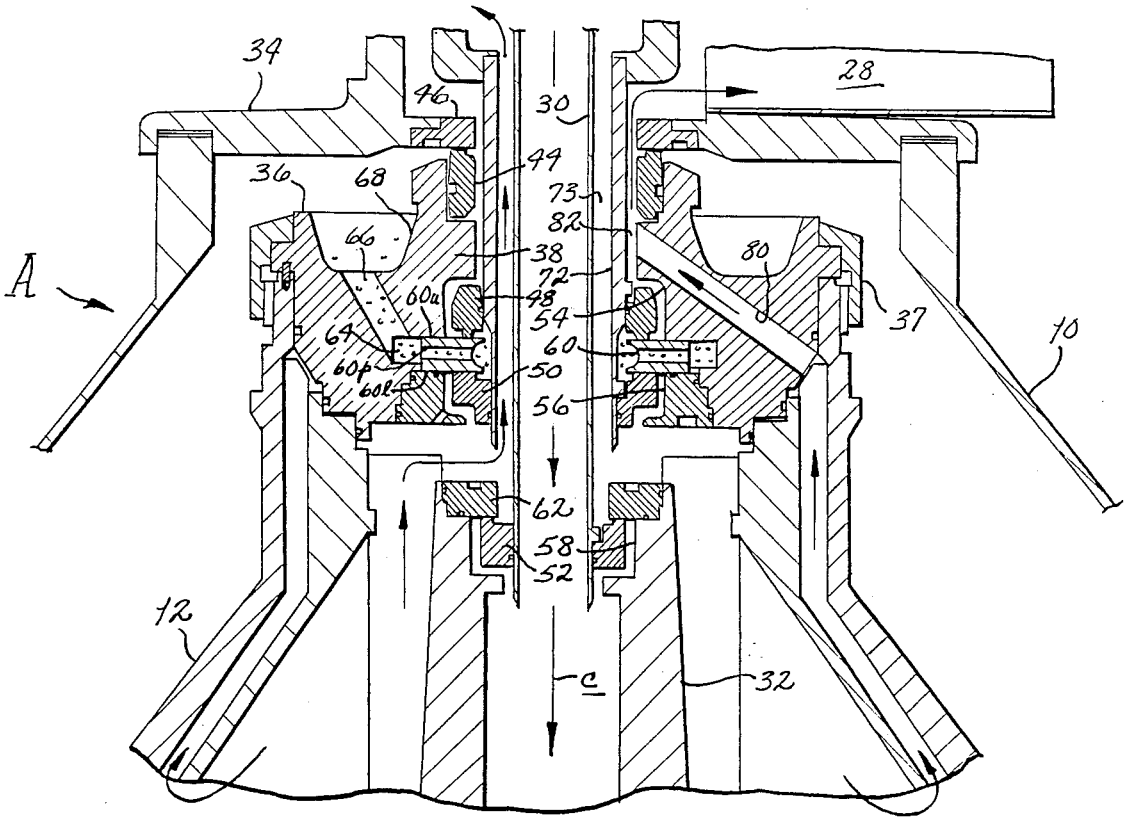
FIG. 2
FIG. 3A
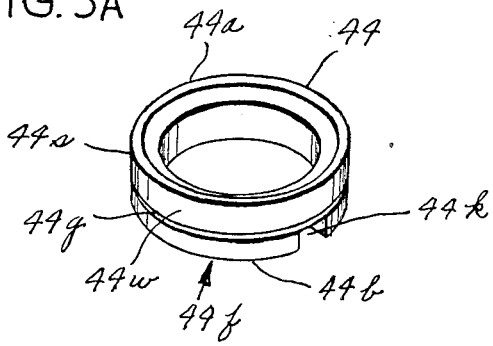
FIG. 3C
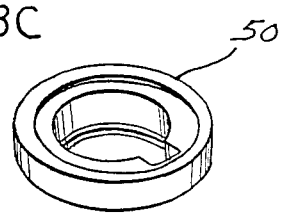
FIG. 3B
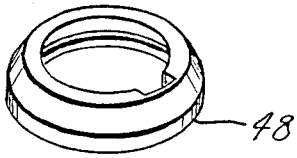
FIG. 3D
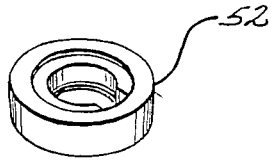

FLOATING SEAL ARRANGEMENT FOR CENTRIFUGAL SEPARATORS AND LIKE ROTATING APPARATUS

BACKGROUND AND SUMMARY OF THE INVENTION

This invention relates to seals for rotating apparatus, such as centrifuges for preventing liquid or gas flow across the seals. More particularly, the invention relates to a floating seal arrangement especially useful for centrifugal separators but also capable of providing fluid-tight sealing function between relatively rotating elements in various rotating vessels, centrifuges, extractors, chambers and related rotating apparatus.

In the design of such rotating apparatus, in which liquid must be prevented from leaking when transferred through passages as from one chamber to another, or from a rotating vessel to a nonrotating passage, various seal designs have been used for maintaining a fluid-tight relationship between apparatus portions, i.e., assemblies, which rotate relative to one another within such assemblies. For example, in centrifugal separators of the type which separate immiscible liquids into distinct constituents of different specific gravities, such as whole milk into a low butterfat-containing portion and a high-butterfat portion, it is typical to employ gas-tight, liquid-tight assemblies having relatively complex seals. Such seals have often required the use of springs, or various other pre-loading mechanisms, for urging the seals into continuous contact with their associated seats for maintaining the sealing relationship. Such seal assemblies typically are to be lubricated by the liquid flowing through the seal assembly. However, if the flow of liquid through the machine should be cut off, then the seals will operate without sufficient lubrication. That is, they will run, in effect, under "dry," unlubricated conditions. In such a liquid separator, if there is termination of liquid from friction of the seal, preloading can very quickly cause the seal to be destroyed by heat and wear.

For these reasons, it has been a known design practice to incorporate means for providing auxiliary lubrication for protecting the seals when the machine is being started and stopped or product flow is interrupted. In such centrifugal separators, start-up may require several minutes (e.g., 8–10 min.) to reach operational angular velocity (e.g., 5000 rpm) and even longer intervals (e.g., 20–30 min.) to stop. For example, water cooling and lubrication protection systems have been used but these are complicated, expensive and undesirable for various other reasons. E.g., for milk separators, auxiliary water protection systems have been used but require tell-tale flow and other cumbersome means for preventing inadvertent mixture of water with milk product streams.

Accordingly, among the several objects of the invention may be noted the provision of improved sealing arrangement for providing fluid-tight sealing for rotating vessels, contrifuges, extractors, chambers and like fluid-handling apparatus; which does not require for the apparatus means for preloading of seals against their seats; which does not require auxiliary liquid or other means cooling or lubricating of the seals for start-up and shut-down or in the event of an interrupt of liquid product from relative to the apparatus and yet which ensures against seal failure during start-up, shut-down or such product interruption; which greatly minimizes seal wear during operation; which provides such apparatus with freedom from seal replacement for much larger periods then heretofore; which enhances sanitation and in-place cleaning of such apparatus; which eliminates problems associated with use of auxiliary seal liquid and its disposal problems; which provides a sealing action characterized by a free-floating motion of seals which allows both lateral and vertical motion of associated rotating portions of the apparatus, such as a centrifuge vessel, without seal damage; which is particularly useful for apparatus handling liquids or fluids in general which have intrinsic lubricating properties; which allows for problem-free operation during lengthy start-up and shut-down modes, as typical of centrifugal separators and extractors; and which is of extremely simple, reliable, and economical design for simplifying the construction, assembly, disassembly and maintenance of the apparatus in which it is employed. It is a related object of the present invention to provide improved rotating apparatus using such sealing arrangement, and specifically, a centrifugal separator manifesting the foregoing characteristics while having various other advantages of great commercial significance.

Briefly, rotating fluid-handling apparatus to which the invention relates has at least first and second elements which rotate relative to the other about a common axis. In accordance with the invention, a seal assembly provides fluid-tight sealing between the elements. The elements each include passages defining between them communication for fluid flow from one element to the other. The seal assembly comprises at least one annular seat carried by one of the elements coaxially with the axis, the other of the elements defining a chamber in proximity to the seat. The chamber carries within it at least one annular seal coaxial with the axis The seal is fluid-actuated. That is, it is shiftable axially within the chamber between a first position, in which the seal is out of sealing contact with the seat, and a second position, in which the seal is in sealing contact with the seat over an annular sealing surface area. The seal and chamber are mutually configured for causing fluid flow from one element to the other through the passages for producing shifting of the seal from the first position to the second position to cause the sealing surface area to be maintained in fluid-tight, fluid-lubricated relationship with the seat in response to pressure produced by the fluid when flowing from one element to the other during relative rotation of the elements, but for permitting shifting of the seal to the second position in the absence of said pressure, whereby to avoid fluid-unlubricated contact of the seal with the seat.

Other objects will be in part apparent and in part pointed out in the following description.

BRIEF DESCRIPTION OF THE DRAWINGS

FIG. 2 is a view similar to FIG. 1 but showing the seals shifted to a second operative, sealing position to provide gas-tight, liquid-tight sealing relationship with certain seats for the seals.

FIGS. 3A–3D are perspective views of shiftable seals utilized in the apparatus of FIG. 1.

DESCRIPTION OF THE PREFERRED EMBODIMENTS

Figure 1:
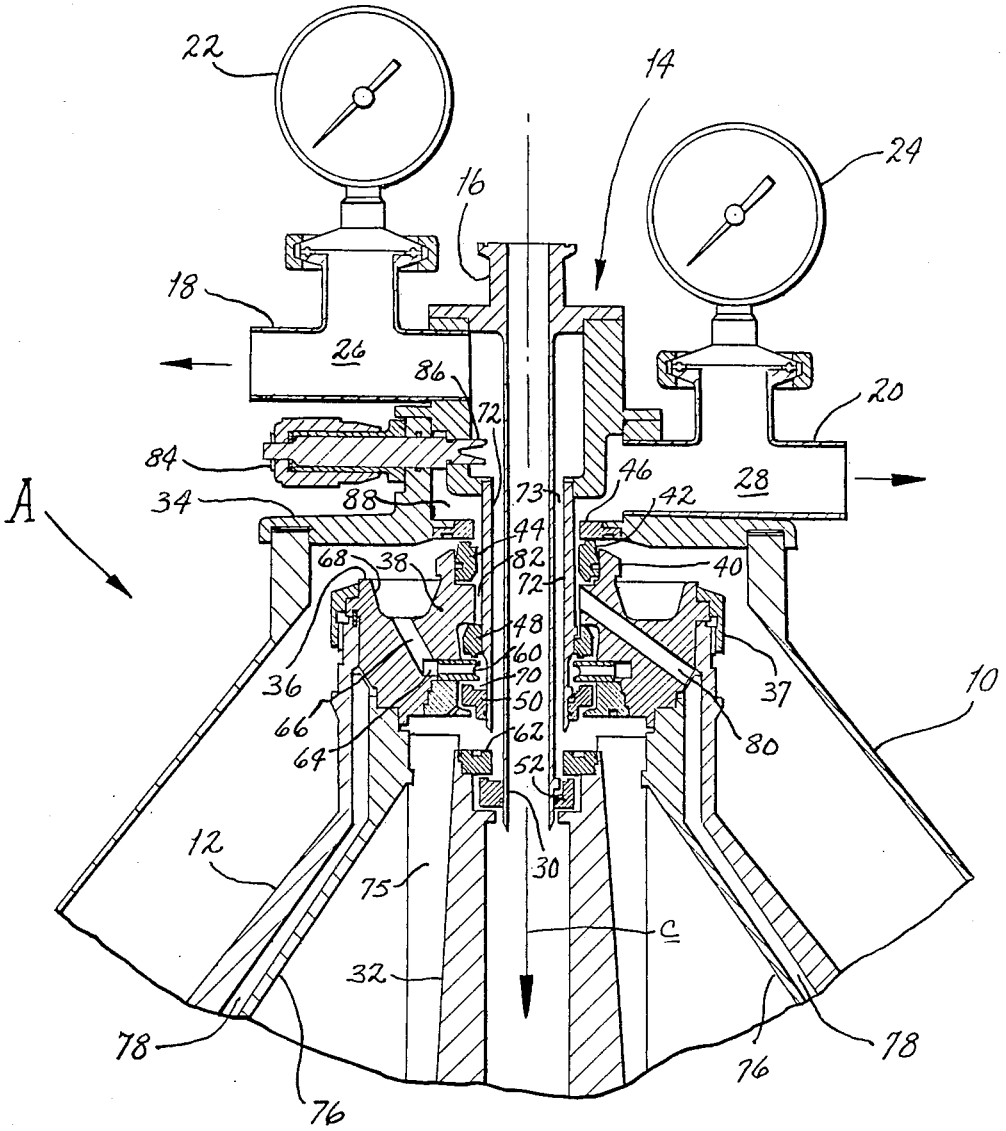
FIG. 1 is a fragmentary vertical cross-section of portions of a centrifugal separator having a seal arrangement in accordance with the present invention, showing seals in a non-sealing inoperative position.

Referring now to the drawings, designated generally at A is rotating apparatus using the invention, as embodied by a centrifugal separator for separating a liquid of immiscible constituents into its separate constituents. Separator A may separate milk, for example, into low (skim) and high butterfat (cream) portions. Separator A has an outer vessel, that is, a so-called hood 10, within which is carried a rotatable inner vessel, i.e., a centrifuge bowl 12, which is driven conventionally for rotation at relatively high angular velocities for causing separation, according to differences in specific gravity, of a liquid into its immiscible constituents.

For this purpose, a nonrotational assembly, designated generally 14, includes an inlet fitting 16, such as for receiving whole milk, for example, and outlet fittings 18, 20, as provided with respective pressure gauges 22, 24 for monitoring pressure of the output constituent streams as developed within corresponding chambers 26, 28 as they are continuously separated centrifugally by rotation of bowl 12 from the feed stream provided through inlet 16.

Assembly 14 includes a cylindrical inlet tube 30 which extends concentrically into vessel 12 and communicates with a core fixture, i.e., tubular shaft 32, of vessel 12 for delivering the inlet feed stream to a lower end portion (not shown) of bowl 12. The latter, together with hood 10, is of conventional design. The features of hood 10 and vessel 12 will thus be well understood by those skilled in the field of centrifugal separator design. It will also be apparent to those in this field that outer vessel or hood 12 is conventionally provided with a flanged upper end assembly or seat fixture 34 which similarly is nonrotating. Fixture 34 closes the upper end of vessel 10 and, as will soon be understood, forms part of a seal assembly of the invention for providing airtight, liquid-tight sealing relationship with the rotating inner vessel. Although not shown, hood 10 is provided with a drain at its lower end. The interior of hood 10 is at atmospheric pressure. Carried at the upper end of bowl 12 is an upper seal assembly 36 which establishes the sealing relationship with assembly 34. Assembly 36, secured by a threaded coupling nut 37, includes a central body portion 38 which is concentric with inlet tube 30, through which extends the common axis c of the apparatus, about which axis inner vessel 12 rotates.

Body portion 38 has at its upper end a collar 40 defining a seal recess or chamber 42 of L-shaped cross section in which is carried a first annular seal **44*a* shown in detail in FIG. 3A. Seal 44 is configured to provide a base portion 44*b* including a cylindrical outer wall 44*w* including an O-ring groove 44*g* and an upper or sealing portion 44*p* which forms a sealing surface 44*a* to be urged against seat 46 which, because of chambered portion 44*c*, has a surface area 44*s* which is less than the area of an exposed lower face 44*f* of base portion 44*b*. Face 44*f* will be exposed to the pressure of fluid passing from one to the other of the relatively rotating elements 34, 36, as will shortly be apparent. Also, observe that an inner wall 44*i* of the seal is dimensioned as shown in FIG. 1 to provide a space between it and the corresponding outer surface of tube 30. Consequently, seal 44 is not to provide a sealing relation with tube 30 but instead, by means of the O-ring in groove 44*g*, with the parallel, cylindrical vertical inner wall surface of chamber 42. Seal 44 is provided with a keyway 44*k* by which a corresponding key 45 formed in the lower wall of chamber 42 is engaged for preventing rotation of seal 44 within chamber 42**.

Seal 44 and chamber 42 are mutually configured and dimensioned to permit seal 44 to be axially shiftable within chamber 42, i.e., along axis c, between a first position (FIG. 1) and a second position (FIG. 2) in which seal 44 maintains a seated, sealing position with sealing surface **44*a* positioned against the corresponding planar, axis-perpendicular surface of an annular seat 46 carried by assembly 34. As will become more fully apparent, such movement occurs in response to the development of pressure in the fluid flowing from one relatively rotating element of the apparatus to the other, causing the seal to develop a sealing pressure applied over said sealing surface area 44*a* which is greater than pressure drop of the fluid initially over the sealing surface area 44*a* during an initial flow of the fluid. When in such sealing position, seal 44 is maintained reliably in sealing contact with seat 46 by the pressure of the fluid upon said lower surface 44*f* of the seal. Moreover, the initial flow of the fluid, e.g., a milk constituent, is such as to wet the sealing surface area 44*a*** and consequently to provide a lubrication of it.

Apparatus A includes additional such seals 48, 50 and 52, each being similarly provided with a base portion including keyway, a sealing portion defining a sealing surface, and a sidewall surface including a groove carrying an 0-ring for sealing relationship with a corresponding wall surface of the chamber in which the respective seal is positioned for axial shifting between an unsealed first position shown in FIG. 1 and a sealing position shown in FIG. 2, in response to the flow of liquid through the apparatus. Thus, corresponding chambers 54, 56, 58 are provided for seals 48, 50, 52. The latter three seals are formed, however, such that their outer walls are spaced from the respective chambers, the inner wall being provided with the 0-ring for sliding sealing relationship with tube 30.

An annular seating ring 60 includes upper and lower seating surfaces **60*u*, 60*l* (FIG. 2) for respectively seating of seals 48, 50, while an annular seat 62 is carried at the upper end of hub 32 for sealing relationship with seal 52 when the latter is shifted upwardly within its chamber 58. It will be noted that seat 60 is provided with radial bores or passages 60*p*, there being several such passages spaced at intervals around the entirety of seat 60. Passages 60*p* communicate with an annular groove 64 which opens through a passage 66 into a moat-like recess 68 formed at the upper end of member 36, for thereby venting, through seat 60, an annular space 70 which extends between seals 48 and 50. Such space is closed and separated from the flow of constituent by a sleeve 72 carried by assembly 14 in coaxial relationship with inlet tube 30, whereby to form a coaxial space 73 through which one constituent may flow upwardly from a region 75 surrounding the core upper end and accordingly into chamber 26. The other constituent, because of its different specific gravity, will be forced against inner surfaces of an inner wall 76 of bowl 12 and, by means of conventional passages (not shown) located at a lower region of bowl 12, into an annular space 78 which communicates through one or more outlet passages 80 in assembly 36. Such passage 80 is shown to open at its upper end into an annular space 82 which extends exteriorly of sleeve 72 for flow of the second constituent into chamber 28**.

At 84 is designated a bleed valve which includes a stem 86 which can be selectively adjusted for permitting a preselected percentage of the constituent being delivered to chamber 26 (such as cream) to be bled back through an annular passage 88 into chamber 28, but such feature is conventional and forms no part of the present invention per se.

Accordingly, the operation of seals 44, 48, 50, 52 and corresponding seats 46, 60, 62 can be more readily understood. It will be seen, for example, that seal 44 is intended to provide a hermetic sealing relationship with seat 46 for sealing off annular passage 82 relative to nonrotating assembly 34. Similarly, seal 48 is shiftable downwardly, and seal 50 shiftable upwardly, within their corresponding chambers, for sealing the lower end of sleeve 72 to hermetically seal the lower end of sleeve 72. Similarly also, seal 52 is shiftable upwardly about the periphery of the lower end of tube 30 for sealing relationship with seat 62 for hermetically sealing the lower end of nonrotating inlet tube 30 relative to the rotational hub 32 of the centrifuge vessel.

Each of seals 44, 48, 50, 52 is formed of carbon composite material, as from commercial available sources, while each of seats 46, 60, 62 is preferably formed of tungsten carbide. Such material exhibits superior performance as a seating surface for the seals, providing extremely low wear and forming a highly desirable relationship with said carbon seals as lubricated by the constituents of the liquid being separated. Other materials which may be used to advantage in the formation of said seats are various alloys of stainless steel, as well as ceramic materials.

In operation, each of seals 44, 50, 52, 54 occupies the position shown in FIG. 1. Accordingly, when apparatus A is first energized for rotation of bowl 12, and in the absence of flow of product into inlet tube 30, hydraulic pressure will not be established in the passages associated with each of the seals. The seals will thereby remain out of contact with the seats to prevent unlubricated relationship. As the centrifuge is brought up to speed such as 5,000 rpm, over the course of several minutes, wear between the seals and corresponding seats is thereby avoided. If, then, flow of product is introduced into inlet tube 30, hydraulic pressure will be developed in each of the chambers occupied by the seals. The seals will be caused to shift in response to hydraulic pressure upon the base portions of the seals to the position shown in FIG. 2, but incipient flow of the liquid streams over the sealing surface areas will lubricate such areas relative to the seats, but the pressure exerted hydraulically against the base areas of each of the seals will be greater than the pressure drop across the sealing surface areas, reliably maintaining each of the seals in the sealing position shown in FIG. 2 with lubrication of said sealing surface areas being effected by the liquid.

Accordingly, each of the sealing means provided by an axially shiftable seal and its corresponding seat is liquid-actuated for selective operation in response to the liquid pressure developed during flow. In practice, such axial shifting of the seals is immediately produced in response to the introduction of product at inlet 16 in such an effective manner that entirely negligible amounts of the product or its constituents are lost between the sealing surfaces and seats during the initial flow.

On the other hand, if product flow provided to inlet 16 should be interrupted, the absence of hydraulic pressure will permit the seals to shift axially to the position shown in FIG. 1 in relieving the contact of the sealing surface areas against the seats to preclude unlubricated operation thereof. Further, when flow is terminated for shut-down, the seals shift to the position of FIG. 1 to remain out of seat contact as the centrifuge vessel 12 angular velocity decreases over a period of several minutes.

Apparatus of the invention demonstrates an unexpectedly high life time of the seals and seats, obviating their replacement at intervals heretofore expected and permitting daily operation of apparatus with routine clean-in-place procedures and without special limitations or precautions in usage, while ensuring hermetic operation with gas-tight liquid-tight operation during product flow.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. Rotating fluid-handling apparatus comprising at least first and second elements, one of the elements being configured rotating relative to the other about a common axis, and a seal assembly for providing fluid-tight sealing between the elements, the elements each including passages defining between them communication for fluid flow from one element to the other, the seal assembly including at least one annular seat carried by one of the elements coaxially with the axis, and at least one annular seal, the other of the elements defining a chamber for the seal in proximity to the seat, the chamber carrying the seal coaxial with the axis, the seal being shiftable axially within the chamber between a first position, in which the seal is out of sealing contact with the seat, and a second position, in which the seal is in sealing contact with the seat over an annular sealing surface area, the seal and chamber being mutually configured for causing fluid flow from one element to the other through the passages for producing shifting of the seal from the first position to the second position and to cause the sealing surface area to be maintained in fluid-tight, fluid-lubricated relationship with the seat in response to pressure produced by the fluid, but for permitting shifting of the seal to the second position in the absence of said pressure, whereby to avoid fluid-unlubricated contact of the seal with the seat.

2. Apparatus according to claim 1 wherein the chamber is positioned relative to said passages for permitting at least an initial flow therethrough of the fluid for lubricating the sealing surface area.

3. Apparatus according to claim 2 wherein the seal is configured to cause the seal to develop a sealing pressure applied over said sealing surface area which is greater than pressure drop of the fluid initially over said sealing surface area during said initial flow, the seal when seated being maintained reliably in sealing contact with the seat by the pressure of the fluid upon the seal.

4. Apparatus according to claim 3 wherein the seal defines a base portion and a sealing portion, the base portion being oriented for exposure to pressure of the fluid, the base portion having greater base surface area than the sealing surface area.

5. Apparatus according to claim 4 wherein the fluid is a liquid substance.

6. Apparatus according to claim 4 wherein the seal is of carbon.

7. Apparatus according to claim 6 wherein the seat is of tungsten carbide.

8. Apparatus according to claim 4 wherein the seal base portion includes a first wall surface for sliding contact over a corresponding surface of said apparatus, the first wall surface including a groove, the groove carrying an 0-ring for sealing against the element surface during movement of the seal between the first and second positions.

9. Apparatus according to claim 8 wherein the seal includes an opposite wall surface, the chamber being configured for permitting at least initial fluid flow axially along th opposite wall surface and toward the seat.

10. Apparatus according to claim 8 wherein the seal first wall surface is cylindrical for conformal relationship to said corresponding apparatus surface, the first wall being concentric with the common axis, said sealing surface area forming an annular surface of rotation concentric with the common axis.

11. Apparatus according to claim 10 wherein the base portion is of greater thickness than the seal portion, the sealing surface area lying in a transverse plane normal to the common axis.

12. Apparatus according to claim 8 wherein the chamber defines a key and the seal includes a keyway for receiving the key to prevent rotation of the seal.

13. Apparatus according to claim 1 wherein said pressure is a pressure differential produced by the fluid when flowing from one element to the other.

14. Apparatus according to claim 1 wherein the fluid is milk.

15. In rotating fluid-handling apparatus comprising at least first and second elements, one of the elements being configured for rotating relative to the other about a common axis, and a sealing assembly for providing fluid-tight sealing between the elements, the elements each including passages defining between them communication for fluid flow from one element to the other, the improvement characterized by the seal assembly comprising a fluid-pressure actuated seal associated with one of the elements and a seat associated with the other of the elements for providing fluid-lubricated sealing contract of the seal with the seat, the seal defining a sealing surface area for said sealing contact, the seal and seat being relatively movable for permitting incipient flow of fluid handled by said apparatus over the sealing surface area in response to introduction of the fluid into the apparatus, for lubricating said sealing surface area relative to the seat, and for causing liquid-tight sealing between the elements to be maintained during relative rotation in response to pressure produced by the fluid but for permitting shifting of the seal to a position out of contact with the seat in the absence of said pressure, whereby to avoid fluid-unlubricated contact of the seal with the seat during said relative rotation.

16. In a centrifugal separator including a nonrotational assembly having a liquid supply inlet, and a rotatably-driven centrifuge vessel for rotation about an axis defined by the assembly, first coaxial conduit means and communicating with the vessel for delivering the liquid supply to the interior of the vessel, second conduit means coaxially surrounding the first conduit means and communicating with the vessel for receiving from the vessel a liquid constituent separated therein, and third conduit means coaxially surrounding the second conduit means and communicating with the vessel for receiving from the vessel another liquid constituent separated therein, the improvement comprising first liquid-actuated sealing means associated with the first conduit means for providing liquid-tight sealing between the first conduit means and the vessel during its rotation, second liquid-actuated sealing means associated with the second conduit means for providing liquid-tight sealing between the second conduit means and the vessel during its rotation, third liquid-actuated sealing means associated with the third conduit means for providing liquid-tight sealing between the third conduit means and the vessel during its rotation, and fourth liquid-actuated sealing means associated with the third conduit means for providing liquid-tight sealing between the third conduit means and nonrotational assembly during rotation of the vessel, each of said sealing means including a seal and a seat, the seal shifting in response to fluid pressure for sealing relationship with the seat for causing a sealing, liquid-lubricated sealing relationship therebetween but permitting shifting of the seal to a position out of contact with the seat in the absence of said fluid pressure, whereby to avoid fluid-unlubricated contact of the seal with the seat.

* * * * *

UNITED STATES PATENT AND TRADEMARK OFFICE

CERTIFICATE OF CORRECTION

PATENT NO. : 4,846,728

DATED : July 11, 1989

INVENTOR(S) : Donald C. Roman

It is certified that error appears in the above-identified patent and that said Letters Patent is hereby corrected as shown below:

Col. 7, line 20, replace "th" with --the--.

Col. 8, line 1, replace "contract" with --contact--.

Signed and Sealed this

Tenth Day of April, 1990

*Attest:*

HARRY F. MANBECK, JR.

*Attesting Officer*

*Commissioner of Patents and Trademarks*